US006093929A

United States Patent [19]

Javahery et al.

[11] Patent Number: 6,093,929

[45] Date of Patent: Jul. 25, 2000

[54] HIGH PRESSURE MS/MS SYSTEM

[75] Inventors: Gholamreza Javahery, Kettleby; Bruce Thomson, Etobicoke; Charles Jolliffe, Kettleby, all of Canada

[73] Assignee: MDS Inc., Etobicoke, Canada

[21] Appl. No.: 09/066,556

[22] Filed: Apr. 28, 1998

Related U.S. Application Data

[60] Provisional application No. 60/046,926, May 16, 1997.

[51] Int. Cl.[7] ..... H01J 49/42

[52] U.S. Cl. ..... 250/282; 250/288; 250/292

[58] Field of Search ..... 250/282, 288, 250/292

[56] References Cited

U.S. PATENT DOCUMENTS 3,335,225 8/1967 Campanella et al. .
4,963,736 10/1990 Douglas et al. ..... 250/292
5,187,365 2/1993 Kelley ..... 250/282
5,248,875 9/1993 Douglas et al. ..... 250/282

OTHER PUBLICATIONS

Thomson, Bruce A. et al, "Improved Collisionally Activated Dissociation Efficiency and Mass Resolution on a Triple Quadrupole Mass Spectrometer System", Analytical Chemistry, vol. 67, No. 10, May 15, 1995, pp. 1696–1704.

*Primary Examiner*—Jack Berman
*Attorney, Agent, or Firm*—Bereskin & Parr

[57] ABSTRACT

A mass spectrometer system in which ions are mass selected in an RF-only quadrupole at relatively high pressure (1 to 7 torr) using FNF or SWIFT, and are then fragmented in a following collision cell which is in the same vacuum chamber, thus reducing pumping needs. The fragments can be mass analyzed in any desired way, including by another RF-only quadrupole in the same vacuum chamber and also using FNF or SWIFT. Triple MS can be performed in the same way.

9 Claims, 3 Drawing Sheets

HIGH PRESSURE MS/MS SYSTEM

This application claims benefit of Provisional Application No. 60/046,926 filed May 16, 1997.

FIELD OF THE INVENTION

This invention relates to a high pressure MS/MS system.

BACKGROUND OF THE INVENTION

Triple quadrupole mass spectrometer systems capable of performing MS/MS usually have two precision quadrupole mass spectrometers separated by a RF-only quadrupole which is operated as a gas collision cell. The first mass spectrometer ("Q1") is used to select a specific ion mass-to-charge ratio (m/z), and to transmit ions with that m/z ratio into the RF-only quadrupole or collision cell ("Q2"). The selected ions (also referred to as the parent ions) are accelerated to an energy of several tens of electron volts before entering the collision cell.

In the RF-only quadrupole collision cell, some or all of the parent ions are fragmented by collisions with a background gas (which is commonly argon or nitrogen added to the collision cell at a pressure of up to several millitorr). The fragment ions, along with any unfragmented parent ions, are transmitted through Q2 into the second precision quadrupole ("Q3"), which is operated in a mass resolving mode. The mass resolving mode of Q3 is normally either to scan over a specified mass range, or else to transmit selected ion fragments by peak hopping (i.e. by being rapidly adjusted to select specific ion m/z ratios in sequence). The ions which are transmitted through Q3 are detected by an ion detector, the signal from which is registered by a data system.

Triple quadrupoles of the kind described are known to be very sensitive and very specific analytical instruments. The sensitivity is due in part to the efficient transmission of ions through the quadrupoles, and to the efficient confinement of ions in the RF-only collision cell. The high specificity is due to the specific nature of the combination of mass selection by Q1, fragmentation to create characteristic fragments in Q2, and mass selection of the fragments in Q3.

Operation of a triple quadrupole as described above requires that the mass resolving quadrupoles Q1 and Q3 operate in a high vacuum region (less than $10^{-5}$ torr), while the collision cell Q2 operates at a pressure of up to several millitorr. Efficient transfer of ions in and out of Q2 requires that the entrance and exit apertures of Q2 be as large as possible. However this results in the need for large vacuum pumps in order to pump the gas which leaks from Q2 into the vacuum chambers containing Q1 and Q3.

In addition, many modern triple quadrupole systems are used with atmospheric pressure ionization sources, such as electrospray, or APCI (atmospheric pressure chemical ionization). The ions which are created in the ion source at atmospheric pressure must be sampled into the vacuum chamber through a small orifice. The gas which enters the vacuum chamber along with the ions to be analyzed, imposes another load on the vacuum pump system, typically of an amount similar to that imposed by the gas leaking from the collision cell.

In one typical configuration now on the market, ions which enter from an APCI or electrospray source are focussed through an RF-only quadrupole which is in front of Q1. This RF quadrupole ("Q0") acts as an efficient containment device for ions and transmits the ions efficiently into Q1. Thus the entire system may contain up to four quadrupoles, in which Q0 and Q2 are RF-only, both operating at a pressure of a few millitorr, while Q1 and Q3 are mass resolving, both operating at a pressure of approximately $10^{-5}$ torr.

The configuration described above requires high capacity and costly pumps. While the configuration described above can be operated as a single mass spectrometer (with no collision gas in Q2, and Q3 in an RF-only mode), rather than as an MS/MS system, it still requires substantial pumping capability.

A known related device, the quadrupole ion trap mass spectrometer, can also provide single MS and MS/MS capabilities. The quadrupole ion trap operates at a pressure of about 1 millitorr of helium, and both mass separation and fragmentation are performed in the same region of space, separated in time. Thus the ion trap is a sequential-in-time device, while the triple quadrupole is a sequential-in-space device.

BRIEF SUMMARY OF THE INVENTION

It is an object of the present invention in one aspect to provide a method of operating a triple quadrupole system with lower pumping requirements, thereby having lower cost. In another aspect the invention provides methods of operation which provide MS/MS/MS capability, thereby providing improved specificity over MS/MS operation. In yet another aspect the invention provides improved methods of operating a quadrupole in a mass resolving mode at an elevated pressure, in order to allow operation of a triple quadrupole with fewer pumping stages.

In one of these aspects the invention provides a method of mass spectrometry comprising mass selecting ions in a first multipole rod set operated at a pressure of at least approximately 1 millitorr, by applying an auxiliary field to said first rod set to excite and thereby remove all ions therefrom except for parent ions, and then transmitting the parent ions into a second multipole rod set operated at substantially the same pressure as the first multipole rod set, and fragmenting parent ions in said second multipole rod set.

DETAILED DESCRIPTION OF PREFERRED EMBODIMENTS

Figure 1:
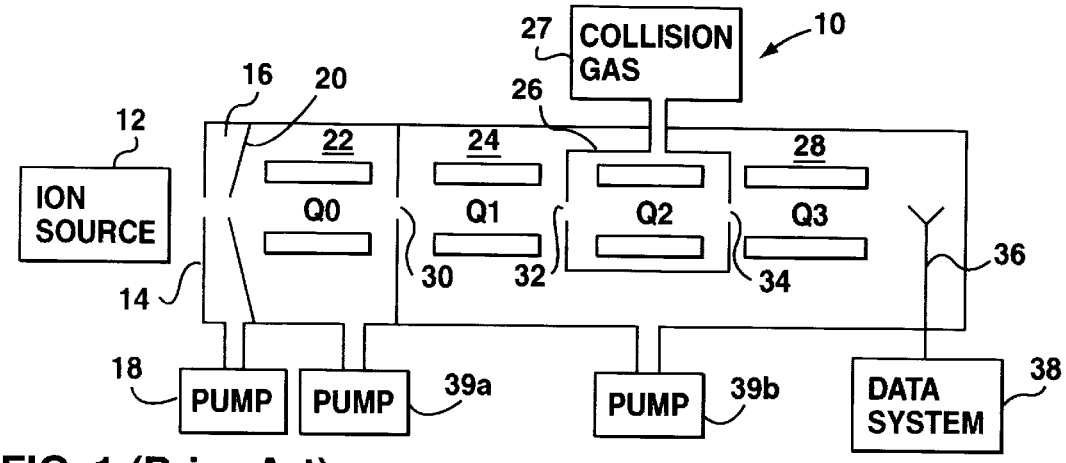
FIG. 1 (Prior Art)
FIG. 1 is a diagrammatic view of a prior art triple quadrupole configuration.

Reference is first made to FIG. 1, which shows a typical prior art triple quadrupole mass spectrometer system 10, of the kind sold for example by the Sciex Division of MDS Inc. of Concord, Ontario, Canada as an API 300 (trade mark) instrument. The mass spectrometer system 10 includes an ion source 12, usually at atmospheric pressure, from which ions are directed through an orifice plate 14, a vacuum chamber 16 pumped by a pump 18, and a skimmer 20 into a set of two vacuum chambers 22, 24. These vacuum chambers contain four quadrupoles Q0, Q1, Q2 and Q3, separated by orifices 30, 32 and 34. (Quadrupole Q2 is in a "can" 26 in chamber 24.) Quadrupole Q3 is followed by a detector 36 connected to a data system 38.

In operation, vacuum chamber 16 is normally pumped to about 2 torr by mechanical pump 18, while vacuum chamber 22 is normally pumped to between about 1 and 7 millitorr, and vacuum chamber 24 is normally pumped to about $10^{-5}$ torr, by high capacity turbo pumps 39*a* and 39*b*. Collision gas (from a source 27) injected into can 26 causes the pressure in Q2 to be between about 1 and 7 millitorr, as is conventional. Ions and gas from the ion source 12 pass through orifice plate 14, skimmer 20, and are transmitted through RF-only quadrupole Q0 into resolving quadrupole Q1, where parent ions are selected. The parent ions are fragmented in collision cell Q2, and the fragments and any unfragmented parent ions are transmitted into Q3 for mass analysis and detection by detector 36.

As indicated, the arrangement shown in FIG. 1 requires high pumping capacity. The pumps needed are bulky and expensive.

Figure 2:
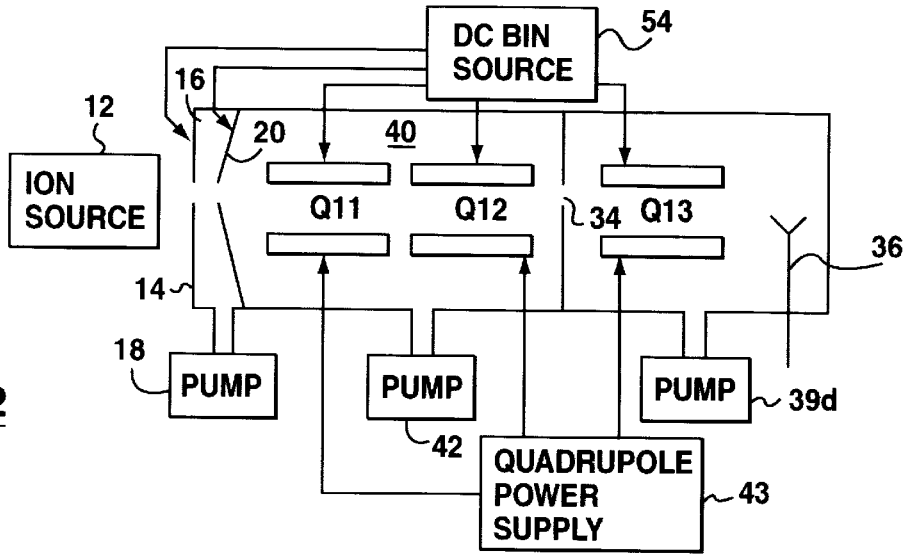
FIG. 2 shows a triple quadrupole configuration according to the invention.

Reference is next made to FIG. 2, which shows a configuration according to the invention and in which corresponding reference numerals are used to indicate parts corresponding to those of FIG. 1. In FIG. 2, Q0, Q1 and Q2 of FIG. 1 are replaced by two quadrupoles Q11 and Q12, both operating in chamber 40 pumped to a pressure of between 1 and 7 millitorr by a 50 liter per second turbo pump 42. Q13 (which corresponds to Q3 in FIG. 1) is as before a conventional RF/DC quadrupole, operated in a resolving mode in a low pressure region (typically $10^{-5}$ torr).

Figure 3:
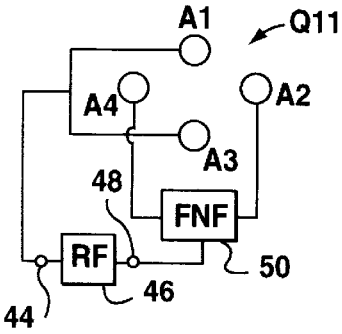
FIG. 3 shows the connection of certain voltage sources to rods of a quadrupole of FIG. 2.

As before, ions enter from the ion source 12 through orifice plate 14 into chamber 16 kept at a pressure of about 2 torr, and are then focussed through skimmer 20 into vacuum chamber 40. Quadrupole Q11 is now operated in an RF-only mode, with an RF voltage applied (from a conventional RF-only quadrupole power supply 43) so that Q11 transmits all ions above a selected mass value. In other words, Q11 operates as a high pass filter, the cut-off on the filter being set to the lowest ion mass of interest for the application in question. As shown in FIG. 3, one pole 44 of a conventional RF voltage source 46 (which forms part of power supply 43) is connected to one pair of rods A1, A3 of Q11, while the other pole 48 is connected to the other pair of rods A2, A4 of Q11.

In addition to the RF voltage applied, an AC voltage is applied by an AC source 50 across opposite rods of one rod pair A2, A4 of Q11 and creates a dipole field. This field consists of a range of frequencies which correspond to the secular frequencies of all ions in the mass range of interest, with a notch or hole in the frequency spectrum. The purpose of the dipole field is to induce a resonant excitation of each of the unwanted ions in Q11, in order to cause their amplitudes of oscillation to increase so that they will strike the rods in Q11 before reaching the end of Q11. Typically the unwanted ions will consist of all ions except one desired mass to be transmitted into Q12. Thus, by applying a range of frequencies, with one "notch" in the range corresponding to the mass of one ion of interest, only that ions of one mass will not be excited, and will be transmitted through Q11 to Q12.

The selection of a single mass ion for transmission while rejecting the other ions is known in connection with ion traps, and is commonly performed by using either the method known as "filtered noise field" ("FNF") or the method known as "SWIFT" (stored waveform inverse Fourier transform), or any of various related methods, all of which are forms of dipole field and act to eject all ions except the ion having the m/z value (or more than one m/z value) of interest. The FNF is usually applied for a period of a few milliseconds, in order to resonate the unwanted ions from the cell. Then, in ion traps, a second frequency is commonly applied to excite the ion of interest (which remains in the cell) to fragment. Finally (still with reference to ion traps), a mass scan is performed in order to sequentially eject the fragment ions and form a mass spectrum. The steps of isolation, fragmentation and ejection are performed sequentially in time. In contrast, in the device shown in FIG. 2, these steps are performed sequentially in space, as the ions flow through the system.

The technique of applying FNF to a quadrupole device is the subject of U.S. Pat. No. 3,334,225 by Langmuir and U.S. Pat. No. 5,187,365 by Kelly. Langmuir shows how to apply the technique to allow only one ion to be passed through a quadrupole. Kelly shows how to apply the method as a mass scanning technique, by "sweeping" the notch through a mass range, or by fixing a notch frequency and sweeping the trapping RF voltage to move ions sequentially through the notch position. Both these methods are applied at the typical low pressure at which a quadrupole is known to operate, i.e. $10^{-5}$ torr. However both methods suffer from the problem that typical transit times of ions through a quadrupole without collisions (i.e. in the low pressure regime of $10^{-5}$ torr) are only of the order of a few tens to a few hundreds of microseconds. Since the frequencies applied to eject ions are often in the range of a few tens of KHz, this means that the ions may experience only a very few number of cycles in the field before reaching the end of the quadrupole. This is not sufficient to ensure rejection unless much higher RF and/or FNF amplitudes are used, which require high power supplies and added cost and complexity. This is particularly true where a wide range of frequencies are to be applied, since the power required at each frequency is additive. Experience with this process in an ion trap shows that several milliseconds may be required to eject the ions.

Therefore, according to the invention Q11 may be operated at a pressure sufficient that collisions between the ions and the background gas in Q11 causes the ions to slow down in Q11 so that they experience more cycles in the dipole field in Q11. In addition, it is known that in the presence of a background gas of a few millitorr pressure, ions are collisionally focussed to the center of the quadrupole. Experience in ion traps has shown that a pressure of about 1 millitorr of helium is advantageous to the ejection process, since under those conditions all ions begin from near the center of the trap, with little excess energy. Thus the presence of a background gas is useful both in slowing the ions down, and in collisionally focussing them toward the center of the device.

The inventors have found that at a pressure of a few millitorr in an RF quadrupole of 20 cm length, the transit time of ions may be of the order of several hundreds of microseconds to greater than 1 millisecond, i.e. it is increased approximately by a factor of 10 from the transit time in the low pressure regime. For example, the transit time of m/z 609 from reserpine, introduced at an energy of approximately 1 eV into a pressure of 7 millitorr in a 20 cm RF-only quadrupole, has been measured at 1.5 milliseconds.

The longer time spent in the quadrupole due to collisions with the background gas allows more time for rejection of unwanted ions, and thus permits more efficient mass selection.

If the device shown in FIG. 2 is to operate in a single MS mode, in order to transmit ions from the ion source without fragmentation, then Q12 is operated without inducing fragmentation. Mass selection may be achieved by operating Q11 as a mass selection device, by scanning or sweeping the notch through the frequency range corresponding to the mass range of interest. Alternatively, mass selection may be achieved by operating Q13 in a resolving mode, with no mass selection in Q11. In this case, a spectrum is produced by the conventional means of scanning the RF and DC voltages on Q13, maintaining a constant DC/RF ratio, using conventional DC and RF source 52.

If the device shown in FIG. 2 is to operate in the MS/MS mode, then Q11 is operated in a mass selection mode, by applying the FNF field with one or more notches. Mass selected ions reaching Q12 are then excited to fragment in Q12 by one or more of the following methods.

(1) Ions are accelerated from Q11 into Q12 by applying a lower rod-offset voltage (which is the conventional DC bias voltage applied to all four rods) to Q12 than is applied to Q11, from DC source 54. This establishes an electric field between the two rod sets Q11 and Q12 which accelerates ions from Q11 into Q12. If the field is strong enough, and the pressure low enough, then ions are accelerated sufficiently between collisions to acquire sufficient energy to fragment in Q12. This mode is similar to the conventional mode of operation of the triple quadrupole 10, where ions are accelerated in the low pressure region of Q1 before entering the higher pressure region of collision cell Q2.

Figure 4:
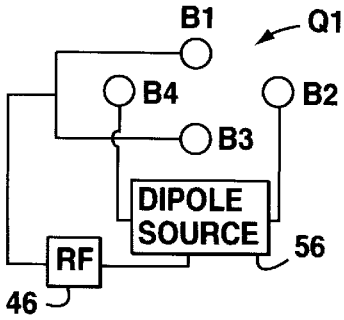
FIG. 4 shows the connection of other voltage sources to rods of a quadrupole of FIG. 2.

(2) Ions may be excited radially by applying a weak dipole field, from source 56 shown in FIG. 4, between one or both pairs of rods B1, B2, B3, B4 of Q12 in order to cause the selected ion to increase its amplitude of radial oscillation and to fragment in Q12 by collisions with the background gas as it passes through Q12. This method is analogous to that used in an ion trap, where ions are excited to cause them to fragment by excitation applied at their secular frequency of oscillation in the trap. This method requires that the ions be gently excited so that their amplitude of oscillation does not exceed the space in between the rods, in order that the ions will not strike the rods.

Figure 5:
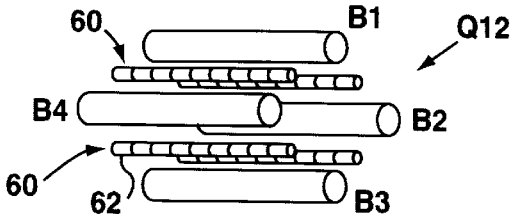
FIG. 5 shows auxiliary rods used with a quadrupole of FIG. 2.

(3) Ions which enter Q12 may be excited axially by applying an oscillating axial electric field, as described in copending PCT application Ser. No. PCT/CA 96/00541 filed Sep. 8, 1996 and assigned to MDS Inc., the assignee of this application. The axial excitation is not a resonant process, so the frequency may be optimized independently of the ion mass. Ions passing through Q12 are accelerated forwards and backwards along the axis, experiencing several oscillations in their transit time. This increases the total path through the device, and thus the number of collisions and the probability of fragmentation. In addition the ions may be accelerated to higher energies without risking the loss of ions to the rods, since the acceleration is along the axis. The method chosen for creating the axial oscillating field may be any of the methods disclosed in said copending application, including for example providing four segmented auxiliary rods 60 located between the main rods B1–B4 of Q12 as shown in FIG. 5. Appropriate DC voltages are applied to the segments 62 of the auxiliary rods 60 to create an axial field along the length of the main rods B1–B4.

The frequency, amplitude and duty cycle of the oscillating axial field are chosen to ensure that the ions maintain a constant drift forward through the rods of Q12, in order that they do not become trapped. For example ions may be oscillated axially so that the time during which a forward accelerating axial field is applied is longer than the time during which a reverse axial accelerating field is applied, so that the average motion is forward.

Each of these three methods of fragmentation may be applied singly or in combination in order to provide the most efficient fragmentation, depending on the pressure regime of operation.

Ions transmitted through Q12 are collisionally focussed to the center of Q12 (by collisions with the gas which is present), so that they are efficiently transmitted through the aperture 34 into Q13. Q13 is as before operated in a conventional RF/DC mode, either being scanned to produce a mass spectrum of fragment ions, or being stepped to various RF voltages in order to sequentially transmit only specific fragment ions. (This last mode is sometimes referred to as the multiple reaction monitoring or MRM mode.)

Figure 6:
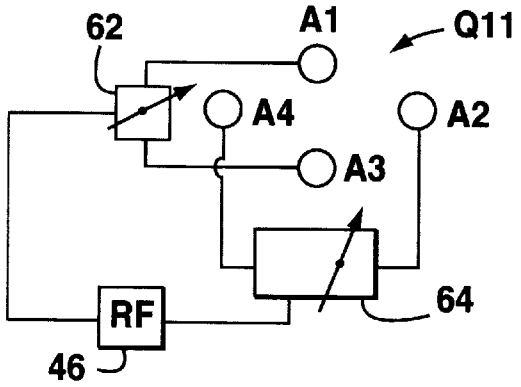
FIG. 6 shows the connection of further voltage sources to rods of a quadrupole of FIG. 2.

With reference to the use of FNF for mass selection in Q11, a simplified method of operation is made possible by the fact that in a quadrupole, ions have frequencies of oscillation in both the x-y and the y-z planes, due to the independent ion motion in the x and y directions. With no applied resolving DC, the frequencies of motion in the x and y directions are the same. In order to eject an ion of a particular m/z ratio from the device, a dipole field can be applied between either pair of rods. If it is desired to reject all ions below and above one particular mass value, dipole fields can be applied between both pairs of rods, and rather than applying simultaneously all frequencies corresponding to unwanted ions, a single frequency may be applied to each pair of rods. The applied frequencies may then be swept rapidly through the required range, so that each ion in sequence comes into resonance and is rejected. Typical such sweepable dipole frequency sources are shown at 62, 64 in FIG. 6, connected to rods A1, A3 and A2, A4 respectively of Q11. (In practice, source 64 may be the same device as source 56 of FIG. 4, operated in a different mode.)

Thus, all ions of m/z value lower than that to be transmitted through Q11 are rejected by sweeping the dipole frequency applied to rods A1, A3 using source 62, while all ions of higher m/z value than that to be transmitted are rejected by simultaneously sweeping the frequency applied to the other set of poles A2, A4, by sweeping source 64. The first frequency sweep (source 62) covers the range from the lowest mass which is present from the source, up to but not including the frequency corresponding to that of the ion of interest. The second frequency sweep (source 64) covers the range from the frequency corresponding to the m/z values just above the ions of interest, to that corresponding to the highest mass range which is present. Thus all ions except those having the m/z value of interest will be rejected. The frequencies may be swept through the ranges several times during the transit time of ions through Q11 in order to ensure effective removal of all unwanted ions.

Figure 7:
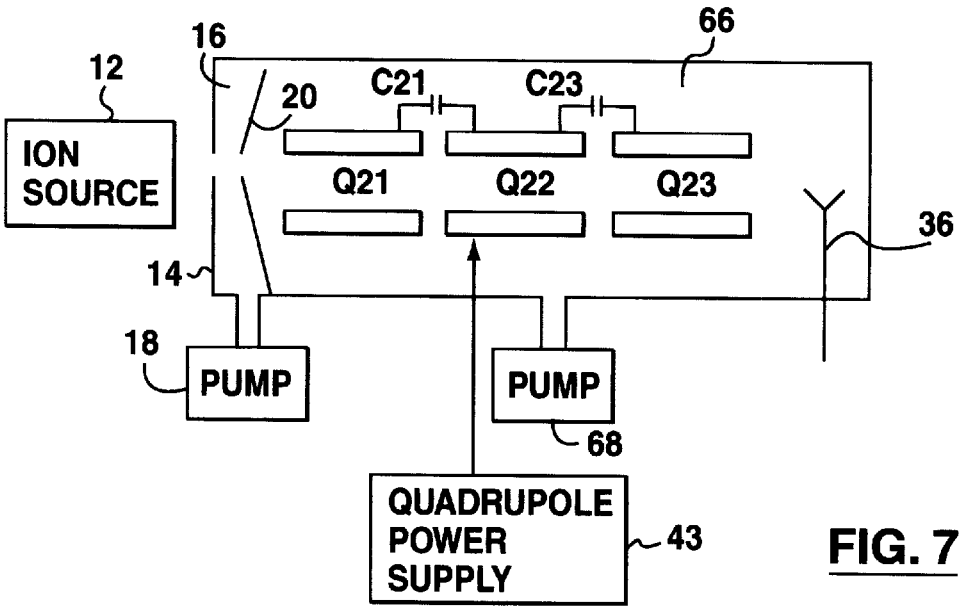
FIG. 7 shows another configuration of a triple quadrupole mass spectrometer system according to the invention.

Reference is next made to FIG. 7, where corresponding reference numerals indicate parts corresponding to those of FIGS. 1 and 2. In FIG. 7, all three quadrupoles Q21, Q22 and Q23 are operated at the same pressure as Q11 and Q12 described in connection with FIG. 2, i.e. at a pressure in the range between 1 and 7 millitorr. Q21, Q22 and Q23 correspond to Q11, Q12 and Q13 respectively of FIG. 3. Q21 and Q22 are operated in the same way as Q11, Q12. Q23 is now operated in a mass selection mode similar to that described for Q11, i.e. in an RF-only mode with FNF as previously described, or with another mode of mass selection which is effective at a higher pressure. This configuration allows pumping of the single vacuum chamber 66 in which all three quadrupoles are contained by one turbo vacuum pump 68 (for example at 50 liters per second to maintain the entire vacuum region at 8 millitorr pressure). It will be realized that the ion detector 36 must also operate at this pressure, or else must be in a separately pumped region (not shown) at lower pressure.

A further cost advantage can be achieved by operating one or both resolving quadrupoles (Q21 and Q23) at a low q value (hence a low RF amplitude value), and scanning the position of the notch. For example, if the RF voltage is kept at less than 500 volts, then solid state amplifiers can be used, rather than the more common tank coil. For quadrupole rods of ⅜" diameter, an operating frequency of 816 KHz, and a maximum mass range of 2000 amu, an upper limit of 500 volts RF would result in a maximum q value for the highest mass ion of 0.1. This results in a saving in both space and power consumption.

Figure 8:
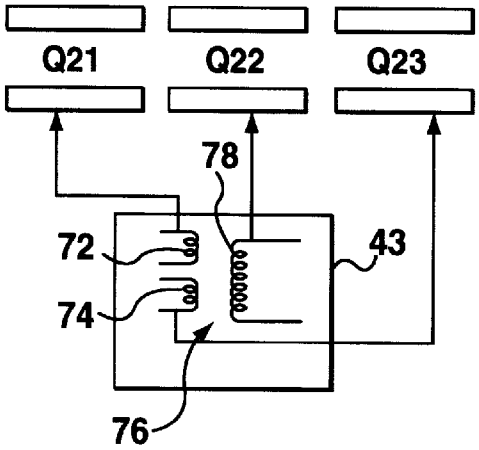
FIG. 8 shows RF connections for a quadrupole of FIG. 7.

Another cost saving method of operating the triple quadrupole shown in FIG. 7 is to use only one RF power supply (part of quadrupole power supply 43), connected for example to Q22, and to capacitively couple the other two quadrupoles (e.g. Q21 and Q23), e.g. by capacitors C21, C23. This results in the RF level on all three quadrupoles being in a fixed ratio. Mass selection in Q21 and Q23 is achieved by applying different notch frequencies to these two quadrupoles. However in order to achieve the full mass range on both Q21 and Q23, the RF levels on these two quadrupoles need to be virtually identical. As shown in FIG. 8, this can be achieved by driving Q21 and Q23 from separate identical secondary coils 72, 74 of transformer 76 (in power supply 43), where the primary coil 78 is connected as shown to Q22.

Figure 9:
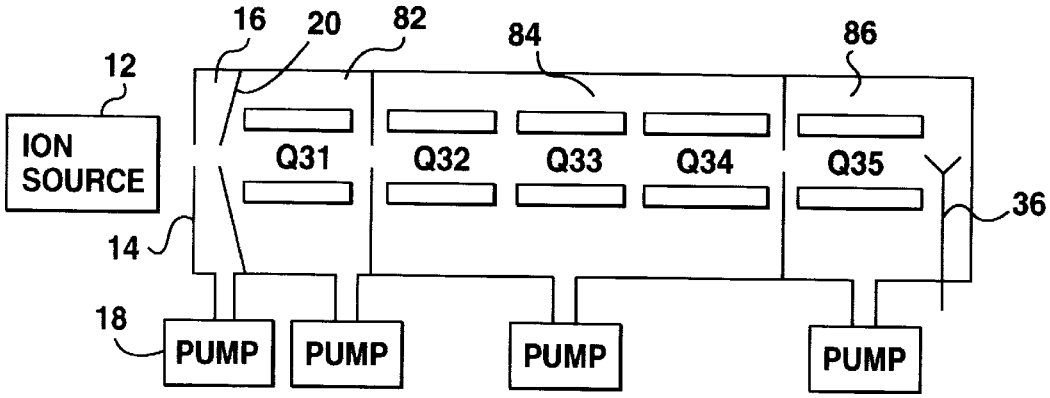
FIG. 9 shows a configuration of a quadrupole system for performing MS/MS/MS.

Another configuration according to the invention is shown in FIG. 9. Here a mass selecting quadrupole Q31 in a chamber 82 pumped to $10^{-5}$ torr is followed by short quadrupoles Q32, Q33 and Q34, all in a single vacuum chamber 84 which is pumped to a pressure of 1 to 7 millitorr, followed by another mass selecting quadrupole Q35 in a vacuum chamber 86 pumped to $10^{-5}$ torr, followed by detector 36. This arrangement allows MS/MS/MS, in which one ion is selected in Q31 as a parent or a precursor ion and is then fragmented in Q32, which acts as a collision cell. The fragments and any unfragmented precursor ions are then mass selected in Q33 (using the methods described) to provide second precursor ions. The second parent or precursor ions are fragmented in Q34 (which also acts as a collision cell), and are then transmitted to Q35 which mass selects from the fragments and any unfragmented second parent or precursor ions.

The technique of MS/MS/MS, which is also performed in ion traps by a series of sequential-in-time steps, is useful for very specific analysis of compounds in the presence of many interferences, and is also useful in order to elucidate the structure of unknown compounds, by analyzing the fragmentation pattern of each of the main fragments of the parent.

The technique of MS/MS/MS using five quadrupoles in series has been shown by Beaugrand et al. at the 1986 ASMS Conference. However these workers used the conventional configuration of an RF/DC quadrupole at low pressure, followed by an RF-only collision cell at higher pressure, followed by an RF/DC quadrupole at low pressure, followed by an RF-only collision cell at higher pressure, followed by a final RF/DC quadrupole at low pressure. This configuration imposes significant complexity and cost of vacuum pumps, since each collision cell is an additional gas load. The configuration in which Q32, Q33 and Q34 are all at the same relatively high pressure as shown, means that the pumping requirements are no greater than for a conventional triple quadrupole which performs MS/MS.

Figure 10:
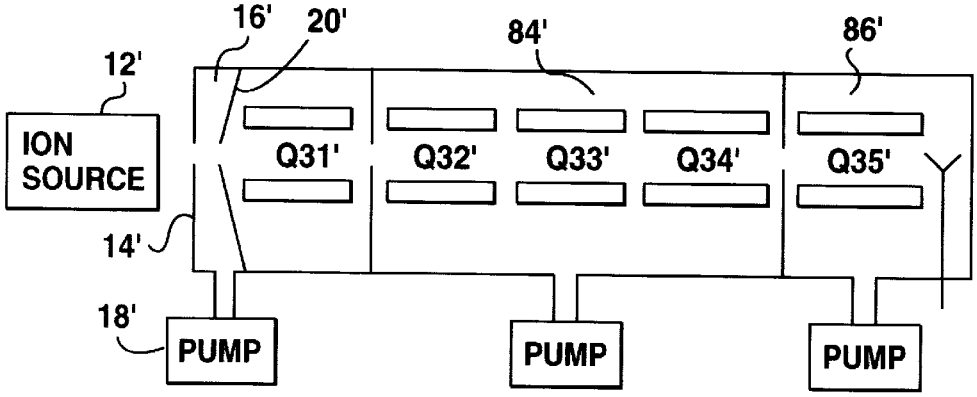
FIG. 10 shows a modified quadrupole configuration for performing MS/MS/MS.

If Q31 is operated as a high pressure mass selection device rather than as a low pressure RF/DC quadrupole, then this provides MS/MS/MS at even lower cost. This version is shown in FIG. 10, in which primed reference numerals indicate parts corresponding to those of FIG. 9. In FIG. 10, Q31 is an RF-only quadrupole in which ions are mass selected using FNF or another appropriate technique, as previously described.

Figure 11:
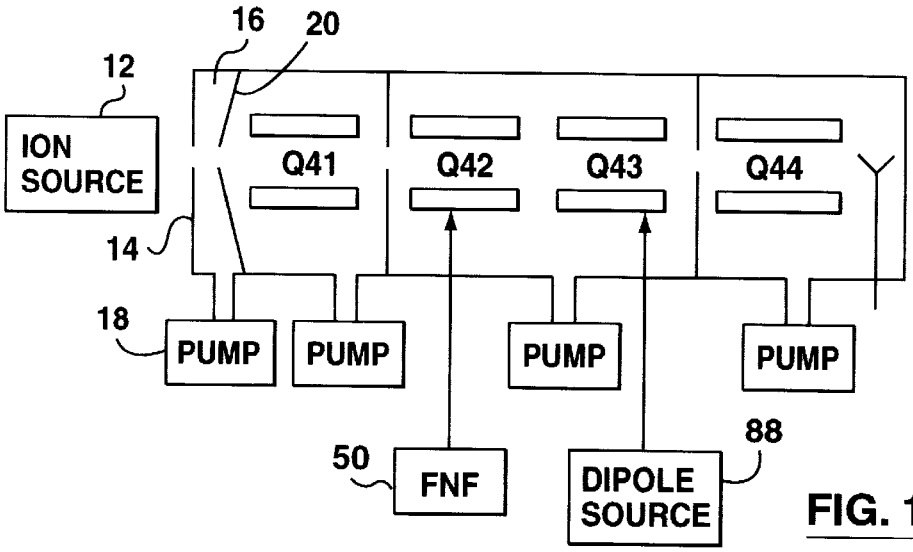
FIG. 11 shows yet another configuration for performing MS/MS/MS.

Another method of providing triple MS is to combine mass selection and fragmentation in the same device, as shown in FIG. 11. Here, ions are mass selected by Q41, which is either a conventional RF/DC quadrupole at low pressure, or a higher pressure RF-only quadrupole using FNF mass selection or other suitable form of mass selection as described above.

Q41 is followed by quadrupoles Q42 and Q43, which are both operated at relatively high pressure (1 to 7 millitorr or higher). Parent ions mass selected by Q41 are accelerated into Q42, to cause the parent ions to fragment in Q42. Simultaneously a notched filtered noise field from source 50 is applied to Q42 to cause all fragments except one selected fragment to be rejected. The amplitude of the excitation of the FNF is selected so that the parent ions are not rejected before they have a chance to fragment in Q42.

The selected fragments are transmitted through Q42 to Q43, a second RF collision cell, where they are fragmented to form second fragments, by any of the available means (e.g. radial or axial excitation). A radial or dipole source is for example shown at 88, connected to two rods of Q43. The resulting second fragments are then mass analyzed in Q44, which is an RF/DC quadrupole operated at low pressure ($10^{-5}$ torr). This provides MS/MS/MS capability with only four quadrupoles.

It will be appreciated that the methods of operating the mass spectrometers as described above can be applied with other mass selection devices or methods in place of the final quadrupole. For example, the final quadrupole may be replaced by a time-of-flight mass spectrometer, where the output from the preceding quadrupole is focussed into an extraction region, and is then accelerated orthogonally into the flight tube of the time-of-flight mass spectrometer. Alternatively, ions may be trapped in the preceding mass spectrometer and then pulsed radially through a slot in the rod into a time-of-flight device, as described in copending provisional application of Charles Jolliffe, Bruce Thomson and John Barry French filed concurrently herewith.

Alternatively, the final quadrupole may be replaced by an ion trap for mass analysis or for further processing using methods which are well understood for ion traps. In general, the advantages which accrue from providing a mass selection device and an ion fragmentation device as described in this application may be similarly realized with any following device which is used for ion reaction, processing or mass analysis. Improvements are due to lower costs associated with reduced pumping requirements and potentially shorter quadrupole devices.

It will also be appreciated by those skilled in the art that wherever dipolar fields have been described as a method of exciting the ions in a quadrupole, quadrupolar fields may be used instead. In cases where the ions are not exactly on the center axis of the quadrupole, a quadrupolar field (or a combination of quadrupolar and dipolar fields) may be more efficient than using only a dipolar field. In addition, in any place where a quadrupole is used simply to provide ion confinement, and is not used to provide mass resolution, then a hexapole or octopole could equally be used, since the ion containment in them is at least as good as in a quadrupole.

I claim:

1. A method of mass spectrometry comprising mass selecting ions in a first multipole rod set operated at a pressure of at least approximately 1 millitorr, by applying an auxiliary field to said first rod set to excite and thereby remove all ions therefrom except for parent ions, and then transmitting the parent ions into a second multipole rod set operated at substantially the same pressure as the first multipole rod set, and fragmenting parent ions in said second multipole rod set.

2. A method according to claim 1 and including the step of transmitting fragmented ions from said second multipole rod set into a further mass spectrometer for mass separation thereof, for detection.

3. A method according to claim 2 wherein said further mass spectrometer is operated at a lower pressure than said first and second multipole rod sets and is operated in an RF/DC resolving mode.

4. A method according to claim 2 wherein said further mass spectrometer is operated at substantially the same pressure as said first and second multipole rod sets, and ions are mass selected in said further mass spectrometer using an RF field and an auxiliary field.

5. A method according to any of claims 1 to 4 wherein the first multipole rod set includes at least two rod pairs, and wherein said auxiliary field is a dipolar field which is simultaneously applied to both said rod pairs, with one frequency applied to one rod pair and a second and different frequency applied to the other rod pair, each frequency being swept to produce rejection of a range of ion masses, the frequency applied to said one rod pair being such as to reject ions of mass to charge ratio lower than that of ions of interest, and the frequency applied to the other rod pair being such as to reject ions of mass to charge ratio higher than that of ions of interest.

6. A method according to any of claims 1 to 4 and including the steps of fragmenting ions to produce ion fragments and isolating selected ones of said ion fragments both in the same selected multipole rod set, by simultaneously fragmenting parent ions in said selected multipole rod set and by applying an auxiliary field to said selected multipole rod set to isolate said selected fragment ions.

7. A method of mass spectrometry comprising providing ions from an ion source, mass selecting said ions from said ion source to provide first parent ions, fragmenting said first parent ions to provide first daughter ions, mass selecting said first daughter ions to isolate said first daughter ions, fragmenting said first daughter ions to provide second daughter ions, and transmitting said second daughter ions into a mass spectrometer for mass separation thereof, for detection; the steps of fragmenting said first parent ions, selecting said first daughter ions, and fragmenting said first daughter ions being carried out in at least two multipole rod sets in a chamber at one pressure, said pressure being at least approximately one millitorr, thereby to provide MS/MS/MS.

8. A method according to claim 7 wherein the mass selection of a parent ion and the formation of a daughter ion are both carried out inside the same multipole rod set.

9. A method according to claim 8 wherein the mass selection of said first parent ions and the formation of said first daughter ions are both carried out inside said same multipole rod set.

* * * * *